US011946643B2

(12) United States Patent
Hasegawa

(10) Patent No.: US 11,946,643 B2
(45) Date of Patent: Apr. 2, 2024

(54) COMBUSTION APPARATUS

(71) Applicant: NORITZ CORPORATION, Hyogo (JP)

(72) Inventor: Takahide Hasegawa, Kakogawa (JP)

(73) Assignee: NORITZ CORPORATION, Hyogo (JP)

( * ) Notice: Subject to any disclaimer, the term of this patent is extended or adjusted under 35 U.S.C. 154(b) by 674 days.

(21) Appl. No.: 17/056,551

(22) PCT Filed: Jun. 19, 2019

(86) PCT No.: PCT/JP2019/024304
§ 371 (c)(1),
(2) Date: Nov. 18, 2020

(87) PCT Pub. No.: WO2020/039723
PCT Pub. Date: Feb. 27, 2020

(65) Prior Publication Data

US 2021/0207803 A1 Jul. 8, 2021

(30) Foreign Application Priority Data

Aug. 24, 2018 (JP) ..... 2018-157155

(51) Int. Cl.
*F23N 5/24* (2006.01)
*F23N 5/18* (2006.01)
*F23N 5/26* (2006.01)

(52) U.S. Cl.
CPC ..... *F23N 5/24* (2013.01); *F23N 5/18* (2013.01); *F23N 5/26* (2013.01)

(58) Field of Classification Search
None
See application file for complete search history.

(56) References Cited

U.S. PATENT DOCUMENTS 4,262,843 A * 4/1981 Omori ..... F23N 3/082 236/15 E
2018/0187921 A1 7/2018 Ojiro

FOREIGN PATENT DOCUMENTS

EP 2985529 A1 * 2/2016 ..... F23J 11/12
JP S49037379 A 4/1974
JP 2004-271112 A 9/2004
(Continued)

OTHER PUBLICATIONS

International Search Report issued in PCT/JP2019/024304, dated Aug. 13, 2019.

*Primary Examiner* — Jason Lau
(74) *Attorney, Agent, or Firm* — Studebaker & Brackett PC

(57) ABSTRACT

An air blowing fan supplies an amount of air corresponding to a fan rotation speed to a burner during operation. A check valve has a biasing force that closes an exhaust vent, and is opened and closed in accordance with a relationship between a gas pressure in an exhaust passage and the biasing force. A controller performs a failure diagnosis for detecting an open failure of the check valve when a phenomenon in which the gas pressure is lower than a predetermined normal pressure range is detected in a case where the fan rotation speed is within a predetermined diagnosis rotation speed region. The diagnosis rotation speed region is set within a rotation speed range in which a degree of opening of the check valve changes with an increase in the fan rotation speed when the check valve is normally opened and closed.

6 Claims, 9 Drawing Sheets

(56) References Cited

FOREIGN PATENT DOCUMENTS

| | | | | |
|---|---|---|---|---|
| JP | 2013-164178 | A | | 8/2013 |
| JP | 2017-020693 | A | | 1/2017 |
| JP | 2017-138012 | A | | 8/2017 |
| JP | 2018-031533 | A | | 3/2018 |
| JP | 2018138852 | A | * | 9/2018 |

* cited by examiner

COMBUSTION APPARATUS

TECHNICAL FIELD

The present disclosure relates to a combustion apparatus, and more particularly to a combustion apparatus including a gas backflow prevention valve (hereinafter, also referred to as "check valve") in a supply and exhaust passage.

BACKGROUND ART

There has been known a configuration in which a combustion apparatus that burns a mixture of air and fuel such as gas includes a check valve to prevent gas backflow in a supply and exhaust passage. Japanese Patent Laying-Open No. 2018-31533 (PTL 1) describes the technique of detecting an open failure of a check valve based on an exhaust detection temperature, in a configuration including the check valve to prevent backflow of acidic water vapor around a heat exchanger.

Japanese Patent Laying-Open No. 2017-20693 (PTL 2) describes a structure of a check valve suitable for arrangement between a main body in which a burner is placed and a fan case that houses a fan that feeds a mixture of air for combustion and fuel into the burner.

CITATION LIST

Patent Literature

PTL 1: Japanese Patent Laying-Open No. 2018-31533
PTL 2: Japanese Patent Laying-Open No. 2017-20693

SUMMARY OF INVENTION

Technical Problem

According to the combustion apparatus described in PIT 1, the open failure of the check valve can be detected based on a behavior of the exhaust temperature when a fan is stopped. Specifically, whether or not the check valve is normally closed in response to a stop of the fan can be determined based on whether or not a temperature difference between the exhaust detection temperature and a room detection temperature is maintained at a value higher than a reference value.

However, the exhaust temperature changes depending on a condition of combustion by a burner, and the room temperature also changes depending on the season. Therefore, even when the check valve is normally closed, the temperature difference between the exhaust detection temperature and the room detection temperature is not caused in some cases. Therefore, erroneous detection of the open failure is concerned.

The present disclosure has been made to solve the above-described problem, and an object of the present disclosure is to enhance the accuracy of detection of an open failure of a check valve arranged in a supply and exhaust passage of a combustion apparatus.

Solution to Problem

According to an aspect of the present disclosure, a combustion apparatus includes: a combustion mechanism that burns a fuel; an air blowing fan that supplies air for combustion to the combustion mechanism; an exhaust vent; a check valve; and a controller. The exhaust vent is provided to discharge combustion gas in the combustion mechanism. The check valve is arranged in a supply and exhaust passage from the air blowing fan to the exhaust vent. The check valve is opened and closed in accordance with a relationship between a gas pressure in the supply and exhaust passage and a biasing force in a closing direction. The controller performs a failure diagnosis for detecting an open failure of the check valve when a phenomenon in which the gas pressure is lower than a predetermined normal pressure range is detected in a case where a rotation speed of the air blowing fan is within a predetermined diagnosis rotation speed region. The diagnosis rotation speed region is set within a rotation speed range of the air blowing fan in which a degree of opening of the check valve changes with an increase in a rotation speed of the air blowing fan when the check valve is normally opened and closed.

Advantageous Effects of Invention

According to the present disclosure, in light of a characteristic relationship (P-Q characteristic) between a gas flow rate and the gas pressure in the rotation speed range of the air blowing fan in which the degree of opening of the check valve changes with the increase in the rotation speed of the air blowing fan, the open failure of the check valve arranged in the supply and exhaust passage of the combustion apparatus can be detected with high accuracy.

DESCRIPTION OF EMBODIMENTS

Figure 1:
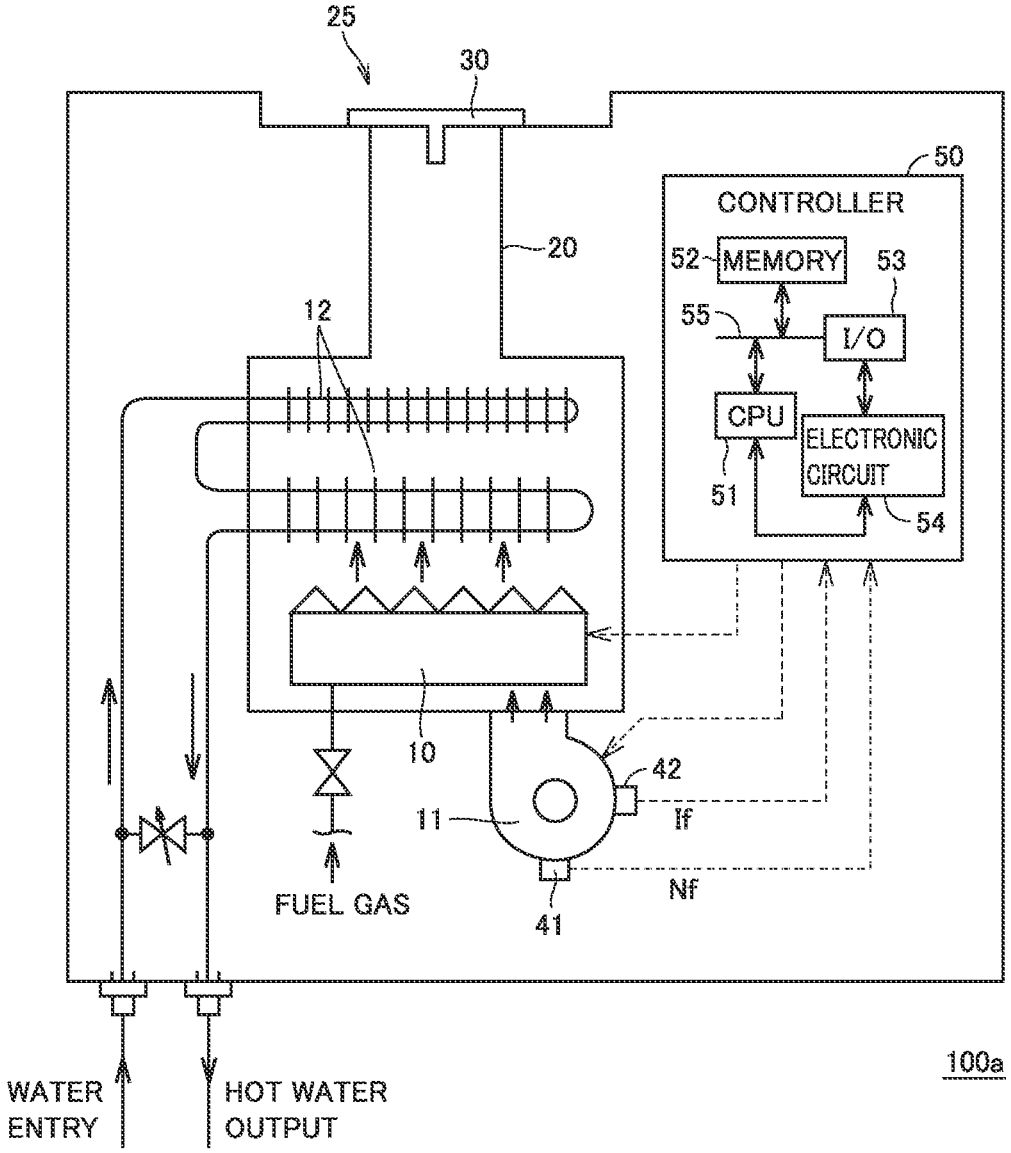
FIG. 1 is a schematic configuration diagram of a water heating apparatus including a combustion apparatus according to a first embodiment.

Embodiments of the present disclosure will be described in detail hereinafter with reference to the drawings, in which the same or corresponding portions are denoted by the same reference characters and description thereof will not be repeated in principle.

First Embodiment

FIG. 1 is a schematic configuration diagram of a water heating apparatus including a combustion apparatus according to a first embodiment of the present disclosure.

Referring to FIG. 1, a water heating apparatus 100*a* includes a burner 10 that burns a fuel represented by gas, an air blowing fan 11, a heat exchanger 12, an exhaust passage 20, an exhaust vent 25, a check valve 30, a rotation speed sensor 41 and a current sensor 42 for air blowing fan 11, and a controller 50. In water heating apparatus 100*a* illustrated in FIG. 1, the above-described components form the combustion apparatus to which the present disclosure is applied. Burner 10 is shown as one example of "combustion mechanism". The fuel burned by burner 10 is not particularly limited.

Air blowing fan 11 is rotationally driven by a not-shown fan motor, to thereby supply air for combustion to burner 10. An amount of air blown from air blowing fan 11 is determined in accordance with a fan rotation speed. Heat exchanger 12 performs heat recovery from combustion gas generated by burner 10 and heats water flowing through heat exchanger 12. Thus, water heating apparatus 100*a* can heat water introduced through an incoming water passage and output hot water.

The combustion gas subjected to heat recovery is guided to exhaust vent 25 by exhaust passage 20 and discharged outside water heating apparatus 100*a*. As described above, in the combustion apparatus, a supply and exhaust passage from air blowing fan 11 to exhaust vent 25 is formed as a result of operation of air blowing fan 11 during a combustion operation by burner 10. In the combustion apparatus according to the present embodiment, check valve 30 that prevents air backflow is disposed in the supply and exhaust passage.

In the configuration example in FIG. 1, check valve 30 is provided at exhaust vent 25. Check valve 30 is made of resin or the like, and has the biasing force that closes exhaust vent 25. For example, the biasing force can be ensured by the check valve 30's own weight.

Figure 2:
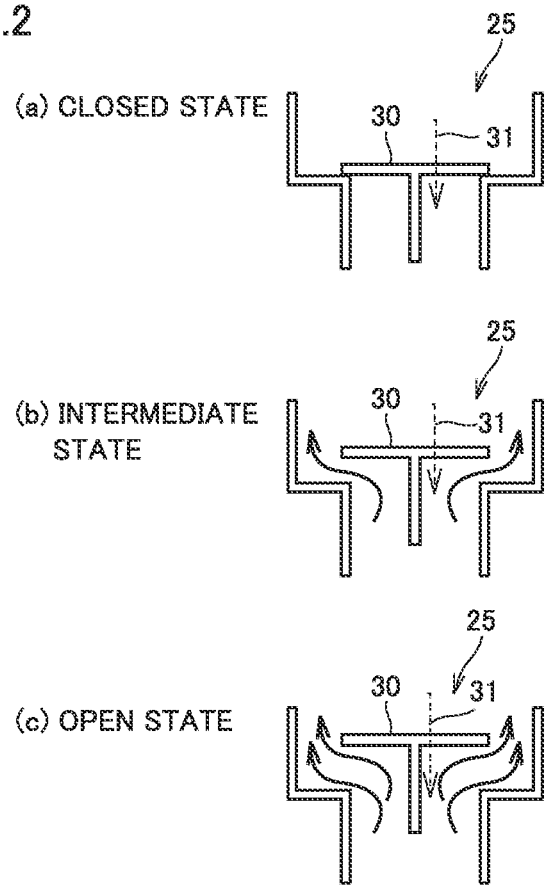
FIG. 2 is a conceptual diagram for illustrating an operation of a check valve.

FIG. 2 shows a conceptual diagram for illustrating an operation of check valve 30.

Referring to FIG. 2(*a*), when combustion by burner 10 is stopped, i.e., when air blowing fan 11 is stopped, check valve 30 moves downward due to its own weight and enters "closed state" in which check valve 30 closes exhaust vent 25. As a result, an input and output passage of the combustion gas via exhaust vent 25 is closed.

Referring to FIGS. 2(*b*) and 2(*c*), during the combustion operation by burner 10, i.e., during operation of air blowing fan 11, an exhaust pressure exceeds the biasing force by check valve 30, and thus, check valve 30 moves upward. As a result, a gap (degree of opening) is generated between exhaust vent 25 and check valve 30, and thus, the combustion gas is discharged from exhaust vent 25.

A stopper (not shown) held by a pillar-like support member is arranged on the upper surface side of check valve 30. When check valve 30 moves upward and abuts against the stopper, check valve 30 enters "open state" shown in FIG. 2(*c*). When check valve 30 enters the open state, the degree of opening of check valve 30 does not change even if an exhaust flow rate becomes larger.

Until check valve 30 abuts against the stopper, check valve 30 is in an intermediate state shown in FIG. 2(*b*). In the intermediate state, the degree of opening of the check valve increases with an increase in the exhaust flow rate. As described above, by using the biasing force due to the check valve 30's own weight, check valve 30 can be opened and closed in conjunction with on and off of air blowing fan 11, without the necessity of being driven by an actuator.

Figure 3:
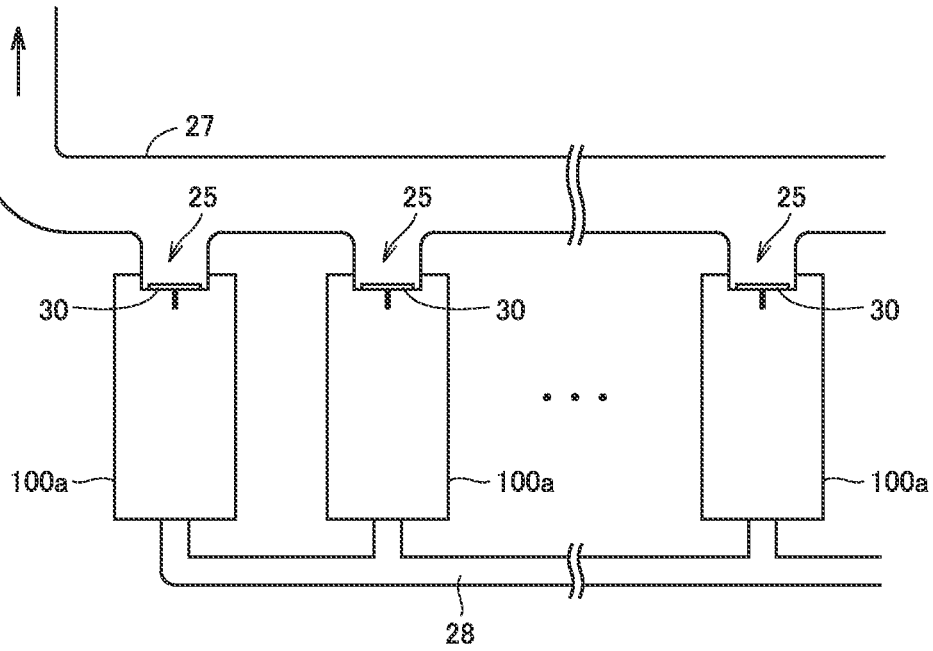
FIG. 3 is a conceptual diagram for illustrating one example of a connection destination of an exhaust vent.

FIG. 3 shows one example of a connection destination of exhaust vent 25.

Referring to FIG. 3, a plurality of water heating apparatuses 100*a* are connected to a shared gas tube 27 on the exhaust side and a shared gas tube 28 on the supply side. Shared gas tube 27 is connected to exhaust vent 25 of each water heating apparatus 100*a*. On the other hand, shared gas tube 28 is connected to air blowing fan 11 (FIG. 1) of each water heating apparatus 100*a*.

In a so-called common vent configuration as in FIG. 3, it is concerned that the exhaust output from a part of water heating apparatuses 100*a* that are performing the combustion operation to shared gas tube 27 flows back from exhaust vent 25 into other water heating apparatuses 100*a* that are not performing the combustion operation. Therefore, check valve 30 is arranged at exhaust vent 25 of each water heating apparatus 100*a*, and check valves 30 of water heating apparatuses 100*a* that are not performing the combustion operation enter the closed state, such that the above-described backflow can be prevented.

However, when there arises a so-called "open failure" in which check valve 30 is maintained in the open state though air blowing fan 11 is stopped, exhaust backflow may occur. Therefore, detection of the open failure is important in the configuration including check valve 30. When there arises a so-called "closed failure" in which check valve 30 is maintained in the closed state though air blowing fan 11 is operated, it is concerned that the combustion gas cannot be normally discharged. Therefore, it is preferable to automatically detect the closed failure, similarly to the open failure.

Referring again to FIG. 1, controller 50 controls an operation of the devices that form water heating apparatus 100*a*. Controller 50 is typically implemented by a microcomputer in which a prescribed program is prestored. For example, as shown in FIG. 1, controller 50 includes a central processing unit (CPU) 51, a memory 52, an input/output (I/O) circuit 53, and an electronic circuit 54. CPU 51, memory 52 and I/O circuit 53 can exchange a signal with each other via a bus 55. Electronic circuit 54 performs a prescribed calculation process using dedicated hardware. Electronic circuit 54 can exchange a signal with CPU 51 and I/O circuit 53. Controller 50 controls execution/stop of the combustion operation by burner 10 and an amount of fuel gas supplied to burner 10, and controls operation/stop of air blowing fan 11 and a fan rotation speed during operation.

Rotation speed sensor 41 is arranged in air blowing fan 11, and current sensor 42 is arranged in a fan motor (not shown) that rotationally drives air blowing fan 11. Outputs of rotation speed sensor 41 and current sensor 42 are input to controller 50.

An amount of air required for combustion by burner 10 is proportional to an amount of fuel supplied to burner 10. Therefore, the rotation speed (hereinafter, also referred to as "fan rotation speed Nf") of air blowing fan 11 is controlled to a target rotation speed set in accordance with the above-described amount of required air. For example, controller 50 controls the rotation speed of air blowing fan 11 by adjusting a driving voltage of the above-described fan motor such that a detection value of fan rotation speed Nf by rotation speed sensor 41 comes closer to the above-described target rotation speed. During this time, a driving current (hereinafter, also referred to as "fan current If") of the fan motor of air blowing fan 11 is detected by current sensor 42.

As described above, fan rotation speed Nf is substantially proportional to the amount of air blown from air blowing fan 11, i.e., a flow rate (hereinafter, also referred to as "exhaust flow rate") of the combustion gas. In addition, fan current If corresponds to a load of the fan motor, and increases and decreases in accordance with a flow path resistance in the supply and exhaust passage and the amount of air blown from air blowing fan 11.

Figure 4:
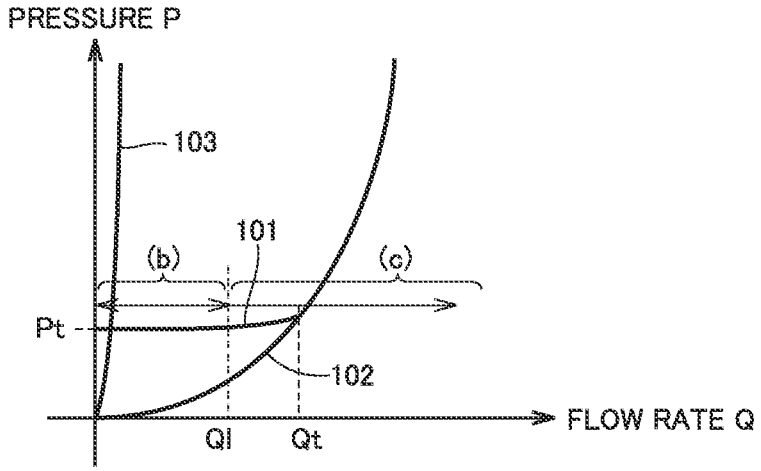
FIG. 4 is a conceptual diagram for illustrating a pressure-flow rate characteristic (P-Q characteristic) in an exhaust passage in which the check valve is arranged.

FIG. 4 shows a conceptual diagram for illustrating a pressure-flow rate characteristic (P-Q characteristic) in exhaust passage 20 in which check valve 30 is arranged. In FIG. 4, the horizontal axis represents an exhaust flow rate Q in exhaust passage 20 corresponding to a gas flow rate in check valve 30, and the vertical axis represents an exhaust pressure P in exhaust passage 20 corresponding to a gas pressure in check valve 30. The P-Q characteristic changes in accordance with a state of check valve 30.

Referring to FIG. 4, a characteristic line 102 indicates a P-Q characteristic when check valve 30 is maintained in the open state (FIG. 2(*c*)). In this case, the exhaust pressure increases like a quadratic function with an increase in the exhaust flow rate. Characteristic line 102 corresponds to a P-Q characteristic at the time of the open failure of check valve 30.

A characteristic line 103 indicates a P-Q characteristic when check valve 30 is maintained in the closed state (FIG. 2(*a*)). In this case, the exhaust passage is closed, and thus, an exhaust resistance increases sharply with an increase in the exhaust flow rate.

A characteristic line 101 indicates a P-Q characteristic when check valve 30 is normal. In the normal state, check valve 30 changes from the closed state in FIG. 2(*a*) to the intermediate state in FIG. 2(*b*) in accordance with an increase in the exhaust flow rate. In the intermediate state, the degree of opening of check valve 30 increases with an increase in exhaust flow rate Q, and thus, the flow path resistance also changes. Therefore, exhaust pressure P remain almost unchanged. For example, in a low flow rate region (Q≤Ql), check valve 30 is maintained in the intermediate state, and thus, exhaust pressure P is maintained at a fixed pressure value Pt and does not change with a change in exhaust flow rate Q.

When exhaust flow rate Q increases and check valve 30 enters the open state in FIG. 2(*c*) (region of Q>Ql), exhaust pressure P becomes equal to characteristic line 102. In FIG. 4, in the region of exhaust flow rate Q≥Qt, characteristic lines 101 and 102 are the same.

In FIG. 4, the P-Q characteristic indicated by characteristic line 102 is observed at the time of the open failure of check valve 30, and the P-Q characteristic line indicated by characteristic line 103 is observed at the time of the closed failure of the check valve 30. Therefore, the open failure of check valve 30 can be detected by distinguishing between characteristic line 101 in the normal state and characteristic line 102. Similarly, the closed failure of check valve 30 can also be detected by distinguishing between characteristic line 101 in the normal state and characteristic line 103. For example, in the intermediate state of check valve 30, a normal pressure range including characteristic line 101 can be preset, and the open failure of check valve 30 can be detected when a detection value of exhaust pressure P is lower than the normal pressure range. Similarly, the closed failure of check valve 30 can be detected when the detection value of exhaust pressure P is higher than the normal pressure range.

As described above, exhaust flow rate Q can be indirectly detected based on fan rotation speed Nf. In addition, a state of exhaust pressure P can be indirectly detected based on fan current If. Therefore, in the combustion apparatus according to the first embodiment, the open failure and the closed failure of check valve 30 are detected based on the detection values of fan rotation speed Nf and fan current If of air blowing fan 11.

Figure 5:
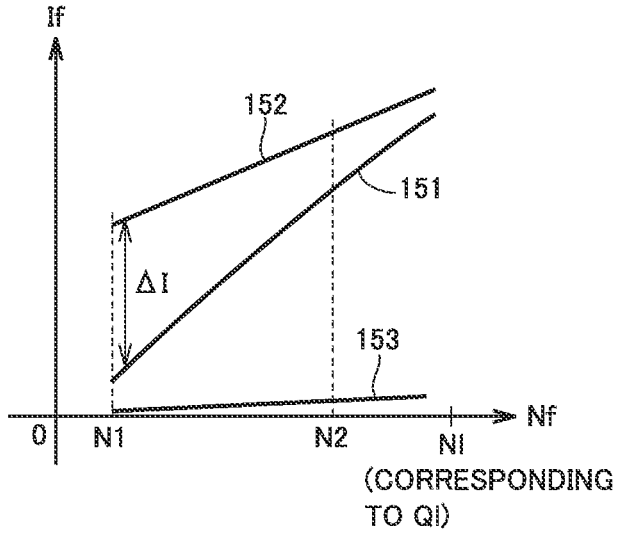
FIG. 5 is a conceptual graph for illustrating a characteristic of a fan current and a fan rotation speed in accordance with a state of the check valve.

FIG. 5 is a conceptual graph for illustrating a characteristic of fan current If and fan rotation speed Nf in accordance with the state of check valve 30.

Referring to FIG. 5, in the region (Q≤Ql) of the exhaust flow rate corresponding to the intermediate state of check valve 30, fan rotation speed Nf satisfies Nf≤Nl. In this rotation region (Nf≤Nl), a characteristic of fan current If with respect to fan rotation speed Nf (hereinafter, also referred to as "Nf-If characteristic"), which corresponds to the P-Q characteristic in the normal state (characteristic line 101 in FIG. 4), follows a characteristic line 151.

In contrast, an Nf-If characteristic that corresponds to the P-Q characteristic at the time of the open failure (characteristic line 102 in FIG. 4) follows a characteristic line 152. Comparing characteristic line 151 with characteristic line 152, the exhaust passage is narrower in a region of low fan rotation speed Nf in the normal state (characteristic line 151) than in the open failure (characteristic line 152) in which the degree of opening of check valve 30 is constant without depending on fan rotation speed Nf. Therefore, fan current If with respect to the same fan rotation speed Nf is larger in characteristic line 152 than in characteristic line 151. A current difference ΔI between characteristic line 151 and characteristic line 152 becomes smaller as fan rotation speed Nf becomes higher, and ΔI becomes almost zero at fan rotation speed Nl (corresponding to exhaust flow rate Ql in FIG. 4) at which check valve 30 enters the open state.

In addition, in the normal state, a load that increases the degree of opening of check valve 30 is applied to air blowing fan 11 (fan motor). Therefore, a rate (slope) of an increase in fan current If with respect to an increase in fan rotation speed Nf is higher in characteristic line 151 in the normal state than in characteristic line 152.

An Nf-If characteristic that corresponds to the P-Q characteristic at the time of the closed failure (characteristic line 103 in FIG. 4) follows a characteristic line 153. Comparing characteristic line 151 with characteristic line 153, check valve 30 is maintained in the closed state at the time of the closed failure, and thus, a load for exhaust is not applied to air blowing fan 11 (fan motor). Therefore, characteristic line 153 has such a characteristic behavior that fan current If and the rate of increase with respect to the increase in fan rotation speed Nf are significantly lower than those in characteristic lines 151 and 152.

Therefore, by setting a reference value Ifr (hereinafter, also referred to as "reference current value Ifr") of fan current If at each fan rotation speed Nf in accordance with characteristic line 151, it is possible to equivalently distinguish between characteristic line 101 and characteristic lines 102 and 103 in FIG. 4 based on comparison between reference current value Ifr and the actual detection value of fan current If.

Figure 6:
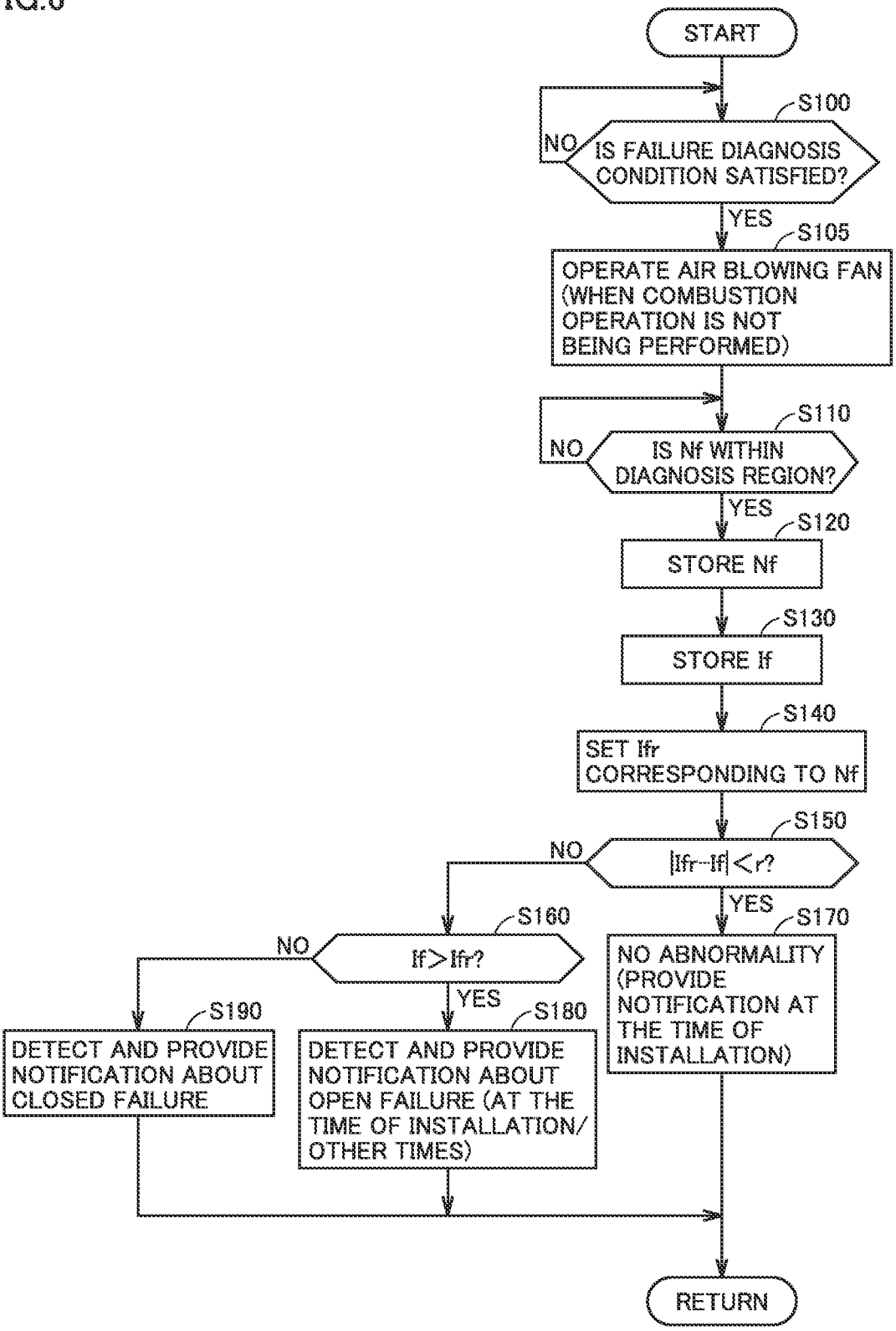
FIG. 6 is a flowchart for illustrating a failure diagnosis process for the check valve in the combustion apparatus according to the first embodiment.

FIG. 6 is a flowchart for illustrating a failure diagnosis process for the check valve in the combustion apparatus according to the first embodiment. Typically, each step shown in FIG. 6 can be implemented by software processing of controller 50.

Referring to FIG. 6, in step (hereinafter, simply denoted as "S") 100, controller 50 determines whether or not a diagnosis condition of check valve 30 is satisfied. In S100, determination of YES can be made, for example, when a power switch of water heating apparatus 100*a* is turned on.

Thus, whenever the power switch of water heating apparatus 100*a* is turned on, the failure diagnosis of check valve 30 can be automatically performed.

Furthermore, determination of YES can also be made in S100 based on a condition that the elapsed time from a previous failure diagnosis or the number of times of turning on the power switch exceeds a predetermined reference value. With this, excessive execution of the failure diagnosis of check valve 30 can be avoided and periodic execution of the failure diagnosis of check valve 30 becomes possible. Alternatively, separately from turning on the power switch, determination of YES can be made in S100 whenever a certain time period elapses.

It is preferable that controller 50 forcibly makes determination of NO in S100 during the combustion operation by burner 10, even when the power switch is ON. However, the failure diagnosis can also be performed during the combustion operation by burner 10, if it does not cause any trouble in the combustion operation. While the combustion operation is not being performed, the operation condition (fan rotation speed) of air blowing fan 11 can be adjusted for the failure diagnosis, and thus, the effect of preventing erroneous failure detection in the failure diagnosis can be enhanced.

Alternatively, the failure diagnosis can be performed in response to a prescribed input operation to a not-shown remote controller of water heating apparatus 100*a*. When the input operation to the remote controller is detected, controller 50 can make determination of YES in S100. Thus, the failure diagnosis of check valve 30 can be performed in response to, for example, a prescribed input operation performed by an operator at the time of installation of water heating apparatus 100*a* and indicating that the failure diagnosis is a diagnosis at the time of installation.

When the failure diagnosis condition is satisfied (YES in S100), controller 50 operates air blowing fan 11 in S105. Thus, air blowing fan 11 is also started up during a time period other than the combustion operation by burner 10. When the failure diagnosis condition is not satisfied (NO in S100), S105 and the subsequent steps are not performed and the failure diagnosis of check valve 30 is not started up.

At the time of the failure diagnosis, in S110, controller 50 determines whether or not fan rotation speed Nf detected by rotation speed sensor 41 is within a predetermined diagnosis rotation speed region. The diagnosis rotation speed region can be predetermined within the range of Nf≤Nl shown in FIG. 5. For example, the region of N1≤Nf≤N2 in FIG. 5 can be determined as the diagnosis rotation speed region.

When fan rotation speed Nf is within the diagnosis rotation speed region (YES in S110), controller 50 stores current fan rotation speed Nf in S120 and stores current fan current if detected by current sensor 42 in S130. In contrast, when fan rotation speed Nf is not within the diagnosis rotation speed region (NO in S110), execution of S120 and S130 is awaited.

In S140, controller 50 sets reference current value Ifr corresponding to fan rotation speed Nf stored in S120. Specifically, a characteristic relationship (Nf-Ifr characteristic) of the reference current value with respect to each fan rotation speed, which corresponds to characteristic line 151 in FIG. 5, is prestored in the not-shown memory of controller 50, and in S140, reference current value Ifr can be set by referring to the above-described Nf-Ifr characteristic. The reference current characteristic can be predetermined at the time of factory shipment.

Alternatively, in order to reflect a characteristic of an exhaust passage (shared gas tube 27 on the exhaust side in FIG. 3) at an installation site, the reference current characteristic can be revised by changing fan rotation speed Nf at a plurality of points and collecting fan current If at each point. However, in the common vent configuration shown in FIG. 3, each of shared gas tubes 27 and 28 normally has a sufficiently large inner diameter, as compared with a diameter of exhaust vent 25, such that no problems occur when all of connected water heating apparatuses 100*a* perform the combustion operation. Therefore, when the failure diagnosis is performed in one water heating apparatus 100*a*, the characteristics shown in FIGS. 4 and 5 are hardly affected even if the exhaust passage is extended outside water heating apparatus 100*a*. Thus, revision of the reference current characteristic is basically unnecessary.

In S150, controller 50 determines whether or not fan current If stored in S130 is within a normal current range including reference current value Ifr set in S140. Determination in S150 can be made based on, for example, whether or not a current difference |fr−If| between fan current If and reference current value Ifr is smaller than a predetermined determination value r. In this case, the normal current range is set at |fr−r<f<Ifr+r. When current difference |Ifr−If| is smaller than determination value r and fan current If is within the normal current range (YES in S150), it is determined in S170 that check valve 30 has "no abnormality", and the current failure diagnosis is ended.

In contrast, when current difference |Ifr−If| is equal to or larger than determination value r (NO in S150), controller 50 determines whether or not fan current If is larger than reference current value Ifr in S160. When if is larger than Ifr (YES in S160), i.e., when fan current If is higher than the normal current range, controller 50 determines that the Nf-If characteristic is close to characteristic line 152 (FIG. 5), and detects "open failure" of check valve 30 in S180 and ends the current failure diagnosis. In this case, it is indirectly detected that a phenomenon in which exhaust pressure Q (gas pressure) is lower than the normal pressure range including characteristic line 101, i.e., the P-Q characteristic that follows characteristic line 102, is seen in the P-Q characteristic in FIG. 4.

In contrast, when If is smaller than Ifr (NO in S160), controller 50 determines that the Nf-If characteristic is close to characteristic line 153 (FIG. 5), and detects "closed failure" of check valve 30 in S190 and ends the current failure diagnosis. In this case, it is indirectly detected that a phenomenon in which exhaust pressure Q (gas pressure) is higher than the normal pressure range including characteristic line 101, i.e., the P-Q characteristic that follows characteristic line 103, is seen in the P-Q characteristic in FIG. 4.

As to determination in S150 and S160, determination value r can also be made different between the If>Ifr side (i.e., open failure detection side) and the If<Ifr side (i.e., closed failure detection side), and the normal current range can also be set to be asymmetric with respect to reference current value Ifr. In this case, by first making determination in S160, and then, making determination in S150 using determination value r set in accordance with a result of determination in S160, determination of no abnormality (S170), detection of the open failure (S180) or detection of the closed failure (S190) can be made.

It is preferable to notify the user, the operator or the like of the failure diagnosis result of check valve 30, and particularly detection of the open failure or the closed failure in S180 or S190.

Figure 7:
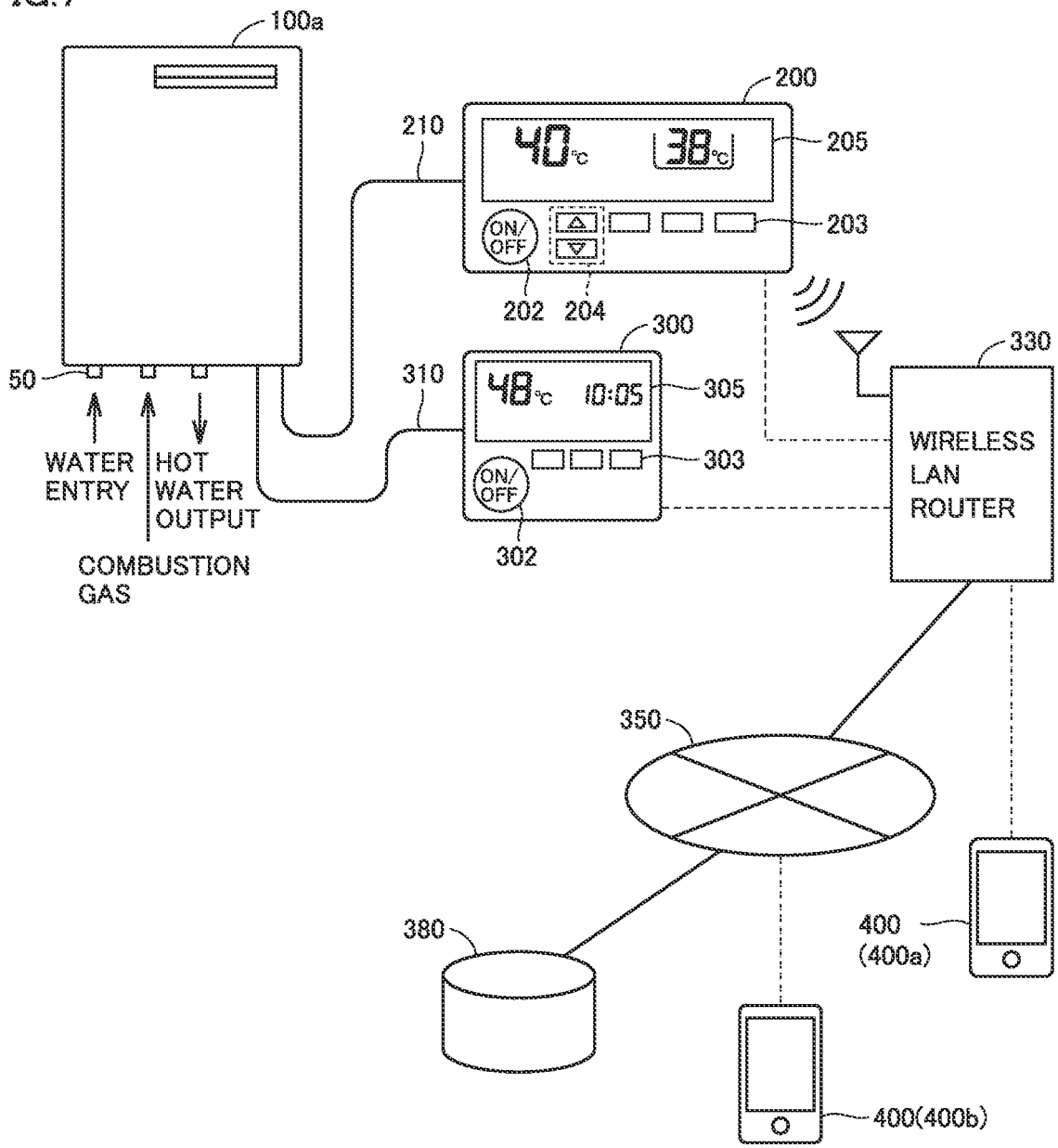
FIG. 7 is a block diagram for illustrating a configuration example of a user interface for the water heating apparatus.

FIG. 7 is a block diagram for illustrating a configuration example of a user interface for water heating apparatus 100*a*.

Referring to FIG. 7, a user command to water heating apparatus 100*a* can be input by remote controllers 200 and 300. Remote controllers 200 and 300 are connected to water heating apparatus 100*a* by communication lines 210 and 310 such as two-wire communication lines.

Remote controller 200 is disposed on a wall surface of a bathroom. Remote controller 200 includes a power switch 202, operation switches 203 and 204, and a display 205. Power switch 202 and operation switches 203 and 204 can be typically implemented by a push button or a touch button. Display 205 can be implemented by, for example, a vacuum fluorescent display.

Remote controller 300 is disposed on, for example, a wall surface of a kitchen. Remote controller 300 includes a power switch 302 for turning on and off water heating apparatus 100*a*, an operation switch 303, and a display 305. Power switch 302 and operation switch 303 can be typically implemented by a push button or a touch button. Display 305 can be typically implemented by a liquid crystal panel.

Furthermore, each of remote controllers 200 and 300 has a not-shown communication adapter built thereinto, and thus, can be communicatively connected to a communication network (typically, the Internet) and a communication terminal through a wireless LAN router 330. For example, by using wireless LAN router 330 that establishes communication connection to Internet 350 as "network extender", remote controllers 200 and 300 can be communicatively connected to a server 380 connected to Internet 350. As a result, remote control and remote monitoring of water heating apparatus 100*a* via server 380 become possible.

For example, by downloading prescribed application software into a communication terminal 400 (typically, a smartphone) communicatively connected to server 380, remote control and remote monitoring of water heating apparatus 100*a* from communication terminal 400 become possible. As to communication terminal 400, remote control and remote monitoring of water heating apparatus 100*a* can be performed from both a communication terminal 400*b* connected to Internet 350 using 4G communication or the like and a communication terminal 400*a* connected to wireless LAN router 330 using a wireless LAN.

In the configuration example in FIG. 7, the failure diagnosis result of check valve 30 can be output, using displays 205 and 305 of remote controllers 200 and 300. Furthermore, the failure diagnosis result of check valve 30 can also be output, using communication terminal 400 such as a smartphone communicatively connected to water heating apparatus 100*a*. Particularly, by using communication terminal 400, the operator or the user can be notified of the abnormality (open failure or closed failure) at the time of occurrence of the abnormality in check valve 30, even if the operator or the user is not near remote controllers 200 and 300. Furthermore, using communication terminal 400, the operator can perform an input operation for starting up a failure diagnosis of check valve 30 at the time of installation of water heating apparatus 100*a*.

It is to be noted that "open failure" is also caused by forgetting to place check valve 30 at the time of installation of water heating apparatus 100*a*. Therefore, at the time of detection of the open failure in S180, the contents of notification can also be changed based on whether or not the current failure diagnosis has been started up in response to the above-described prescribed input operation indicating that the current failure diagnosis is a diagnosis at the time of installation. Specifically, when the current failure diagnosis is a failure diagnosis at the time of installation, the contents of notification are set to seek confirmation as to whether or not placement of check valve 30 is forgotten. In the other cases, the contents of notification can be switched to provide a notification about the occurrence of the abnormality (open failure) in check valve 30. In the failure diagnosis at the time of installation, it is preferable to provide a notification by using remote controllers 200 and 300 and/or communication terminal 400, in the case of "no abnormality (S170)" as well. Furthermore, the above-described revision to the reference current characteristic in the failure diagnosis at the time of installation can also be enabled only when the operator has performed an input operation indicating confirmation that the installation is normal.

As described above, in the combustion apparatus according to the first embodiment, the accuracy of detection of the open failure of check valve 30 can be enhanced based on the P-Q characteristic in the exhaust passage, without using the exhaust temperature that depends on the situation of the combustion operation. Similarly, using the same approach based on the P-Q characteristic, the closed failure of check valve 30 can also be detected with high accuracy.

Furthermore, in the combustion apparatus according to the first embodiment, the failure diagnosis can be performed using the detection values by rotation speed sensor 41 and current sensor 42 of air blowing fan 11 that are normally arranged for control of air blowing fan 11. Therefore, arrangement of a new sensor for the failure diagnosis of check valve 30 is unnecessary, and thus, the combustion apparatus according to the first embodiment has a cost advantage.

In addition, in the combustion apparatus according to the first embodiment, the failure diagnosis can also be performed before the start of the combustion operation, unlike PTL 1 in which the presence or absence of a failure is determined based on a change in temperature situation at the end of a combustion operation. Therefore, a difference in operation condition of air blowing fan 11 caused by the combustion operation can be eliminated and erroneous detection of the abnormality of check valve 30 can be further prevented.

Second Embodiment

In the first embodiment, the failure diagnosis is performed based on the P-Q characteristic, using fan rotation speed Nf and fan current If. However, even when a pressure sensor is arranged in the exhaust passage, the similar failure diagnosis can be performed.

Figure 8:
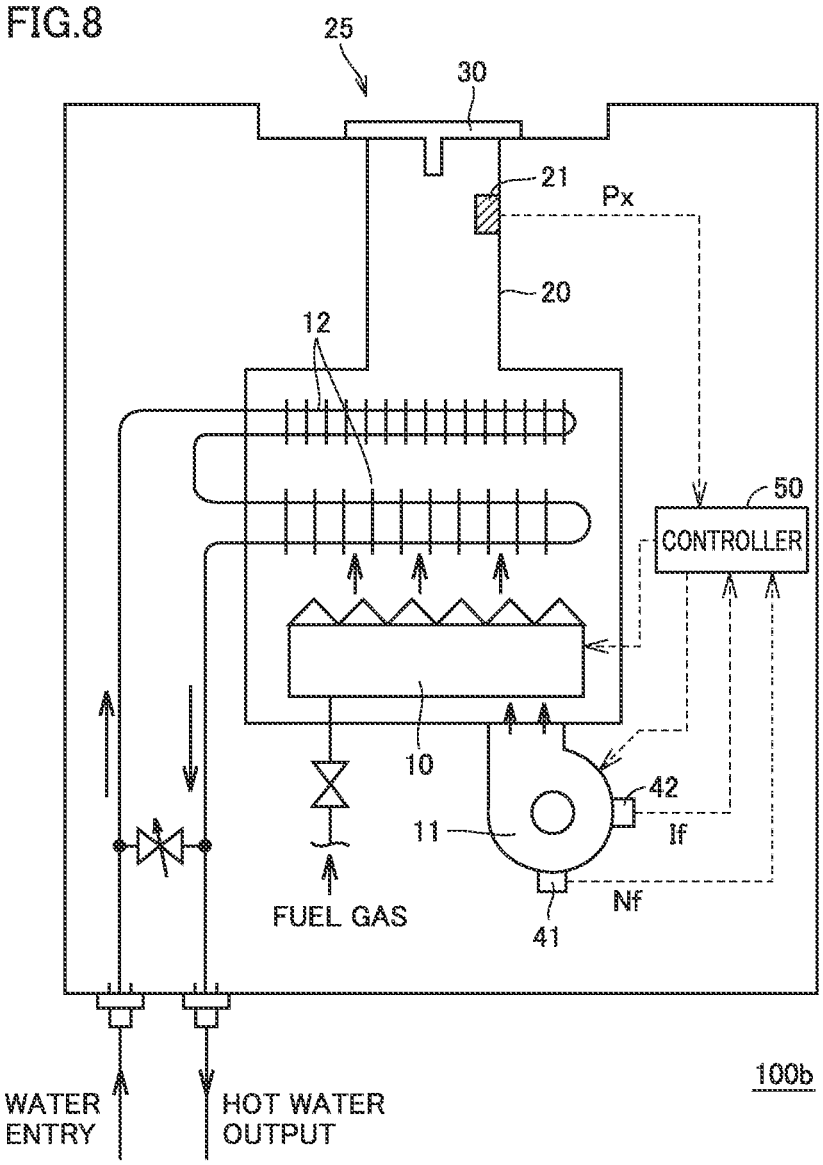
FIG. 8 is a schematic configuration diagram of a water heating apparatus including a combustion apparatus according to a second embodiment.

FIG. 8 is a schematic configuration diagram of a water heating apparatus including a combustion apparatus according to a second embodiment.

Comparing FIG. 8 with FIG. 1, a water heating apparatus 100*b* including the combustion apparatus according to the second embodiment is different from water heating apparatus 100*a* shown in FIG. 1 in that water heating apparatus 100*b* further includes a pressure sensor 21 provided in exhaust passage 20. Pressure sensor 21 detects an exhaust pressure Px in exhaust passage 20 corresponding to a gas pressure in check valve 30. The detection value of exhaust pressure Px by pressure sensor 21 is input to controller 50, similarly to the detection values by rotation speed sensor 41 and current sensor 42.

Since the remaining configuration of water heating apparatus 100*b* according to the second embodiment is the same as that of water heating apparatus 100*a* according to the first embodiment, detailed description will not be repeated. In water heating apparatus 100*b* according to the second embodiment, the failure diagnosis of check valve 30 can be performed using the P-Q characteristic in FIG. 4 more directly.

Figure 9:
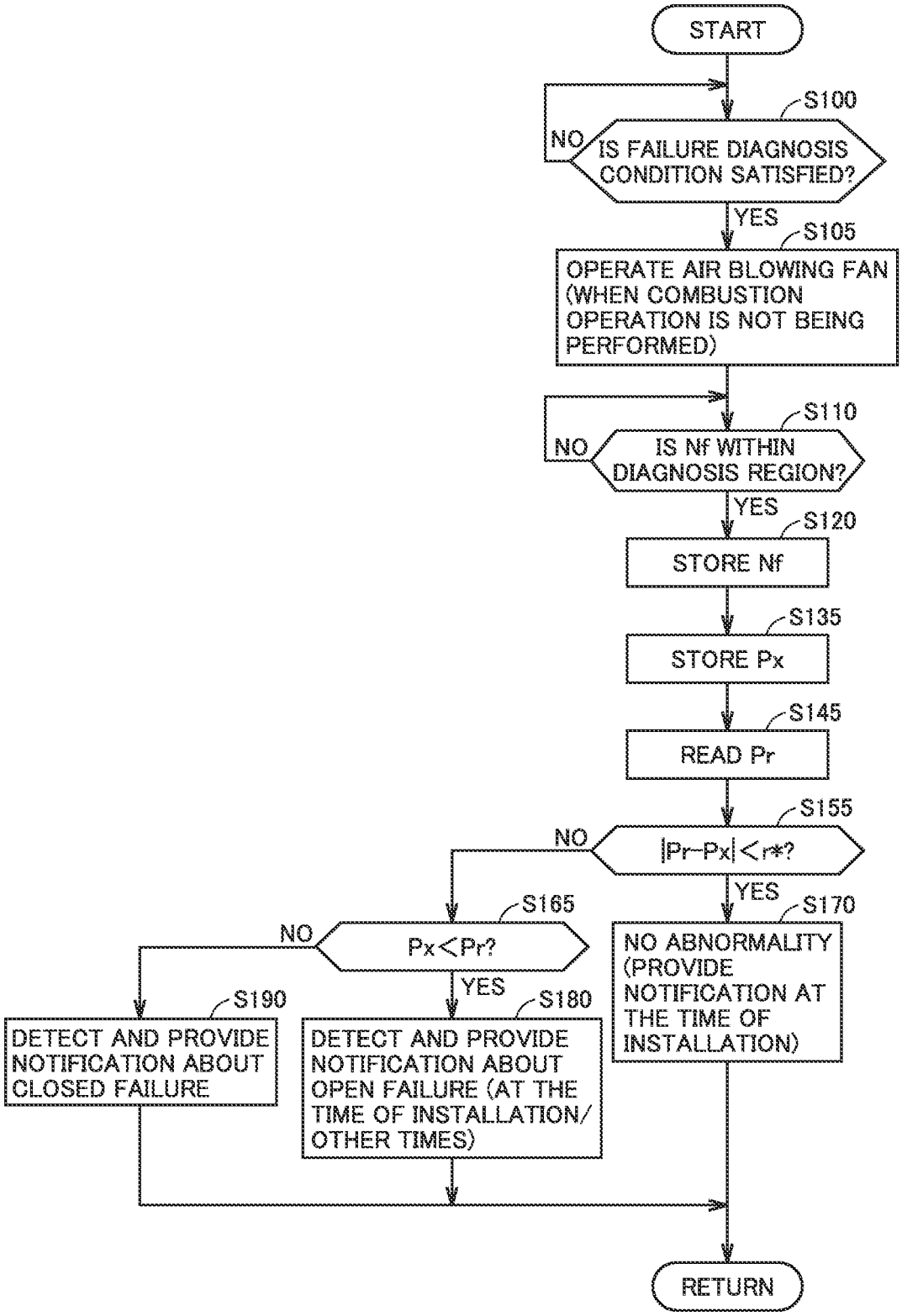
FIG. 9 is a flowchart for illustrating a failure diagnosis process for a check valve in the combustion apparatus according to the second embodiment.

FIG. 9 is a flowchart for illustrating a failure diagnosis process for a check valve in the combustion apparatus according to the second embodiment.

Referring to FIG. 9, when controller 50 starts up the failure diagnosis of check valve 30 in S100 to S110 similar to those in FIG. 6, controller 50 stores current fan rotation speed Nf in S120, and stores current exhaust pressure Px detected by pressure sensor 21 in S135. A diagnosis rotation speed region in the second embodiment is also set to correspond to a region where check valve 30 is in the (b) intermediate state in which the exhaust pressure in FIG. 5 has a constant value. Therefore, in the second embodiment as well, determination in S110 can be made based on whether or not N1≤Nf≤N2 is satisfied, similarly to the first embodiment.

In S145, controller 50 reads a reference pressure value Pr. Reference pressure value Pr is set to correspond to a constant pressure value Pt in the (b) intermediate state of characteristic line 101 in FIG. 4. A value predetermined at the time of factory shipment or a value revised using a pressure detection value in the failure diagnosis at the time of installation can be used as reference pressure value Pr. However, revision of the reference pressure value is basically unnecessary as described above. Although revision of the reference pressure value at the time of installation is possible, the revision can be enabled under a condition that the operator has performed an input operation indicating confirmation that the installation is normal, as described above.

In S155, controller 50 determines whether or not exhaust pressure Px stored in S135 is within a normal pressure range including reference pressure value Pr. For example, by comparing a pressure difference |Pr−Px| between exhaust pressure Px stored in S135 and reference pressure value Pr set in S145 with a predetermined determination value r*, it can be determined whether or not exhaust pressure Px is within the normal pressure range.

When pressure difference |Pr−Px| is smaller than determination value r* (YES in S155), it is determined that check valve 30 has "no abnormality" in S170 similar to that in FIG. 6, and the current failure diagnosis is ended.

In contrast, when pressure difference |Pr−Px| is equal to or larger than determination value r* (NO in S155), controller 50 determines whether or not reference pressure value Pr is larger than exhaust pressure Px in S165. When Pr is larger than Px (YES in S165), controller 50 determines that exhaust pressure P is lower than the normal pressure range and the P-Q characteristic is close to characteristic line 102 (FIG. 4). Therefore, in S180 similar to that in FIG. 6, controller 50 detects "open failure" of check valve 30 and ends the current failure diagnosis.

In contrast, when Px is larger than Pr (NO in S165), controller 50 determines that exhaust pressure P is higher than the normal pressure range and the P-Q characteristic is close to characteristic line 103 (FIG. 4). Therefore, in S190 similar to that in FIG. 6, controller 50 detects "closed failure" of check valve 30 and ends the current failure diagnosis. Since S170 to S190 are the same as those in the first embodiment (FIG. 6), detailed description will not be repeated.

Similarly to the first embodiment, as to determination in S155 and S165, determination value r* can also be made different between the Px<Pr side (i.e., open failure detection side) and the Pr<Px side (i.e., closed failure detection side), and the normal pressure range can also be set to be asymmetric with respect to reference pressure value Pr. In this case, by first making determination in S165, and then, making determination in S155 using determination value r* set in accordance with a result of determination in S165, determination of no abnormality (S170), detection of the open failure (S180) or detection of the closed failure (S190) can be made.

As described above, arrangement of pressure sensor 21 is necessary in the combustion apparatus according to the second embodiment, as compared with the first embodiment. However, the open failure of check valve 30 can be detected with high accuracy, more directly based on the P-Q characteristic in the exhaust passage. Furthermore, the closed failure of check valve 30 can also be detected with high accuracy, more directly based on the P-Q characteristic.

In addition, in the combustion apparatus according to the second embodiment, the failure diagnosis can also be performed before the start of the combustion operation, similarly to the first embodiment. Therefore, a difference in operation condition of air blowing fan 11 caused by the combustion operation can be eliminated and erroneous detection of the abnormality of check valve 30 can be further prevented.

Third Embodiment

In the first and second embodiments, description has been given of the configuration example in which check valve 30 is arranged at exhaust vent 25. However, check valve 30 can be arranged at an arbitrary position in the supply and exhaust passage from air blowing fan 11 to exhaust vent 25. In a third embodiment, a configuration of a combustion apparatus having a check valve built thereinto will be illustrated.

Figure 10:
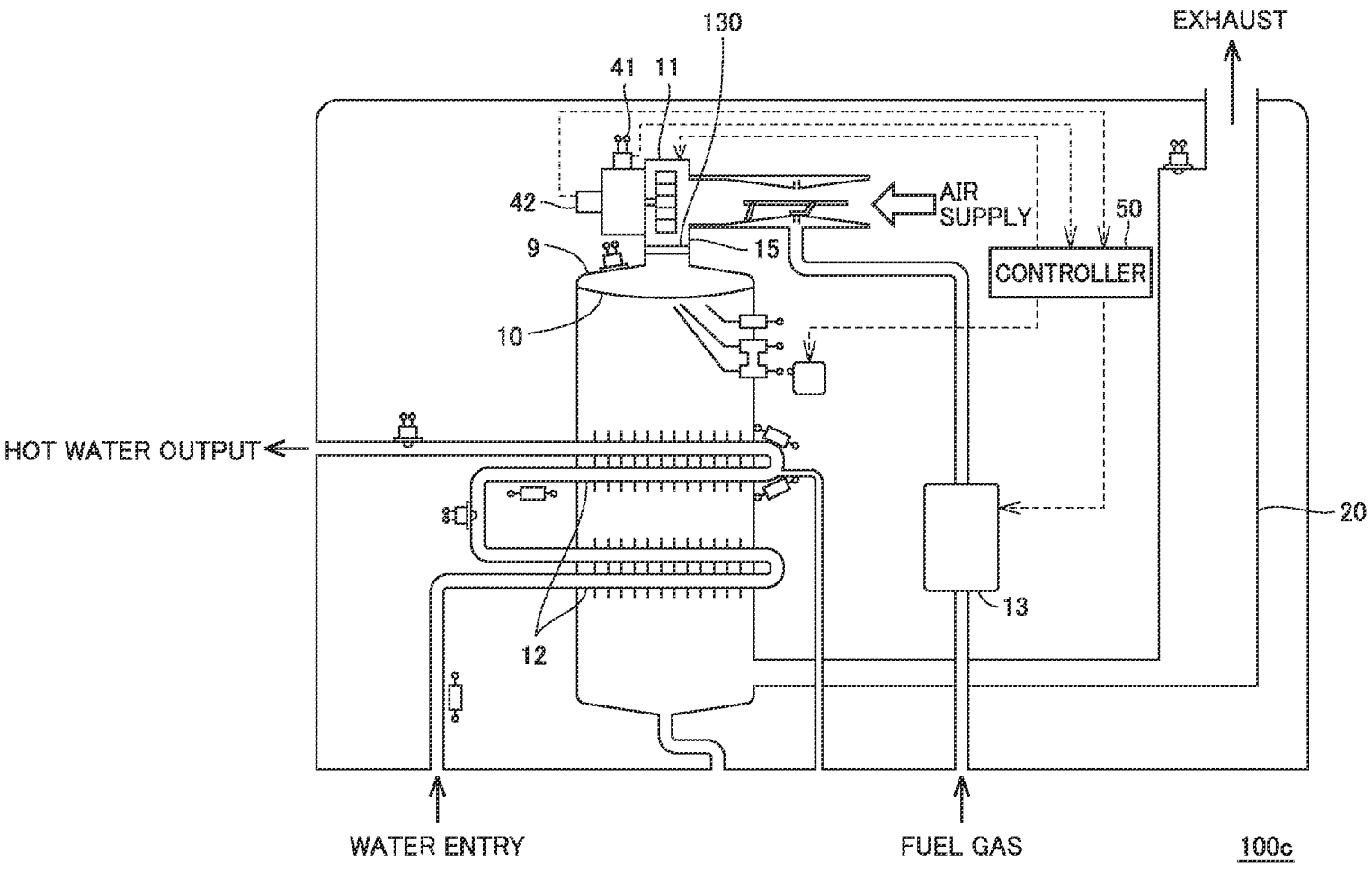
FIG. 10 is a schematic configuration diagram of a water heating apparatus including a combustion apparatus according to a third embodiment.

FIG. 10 is a schematic configuration diagram of a water heating apparatus including a combustion apparatus according to the third embodiment.

Referring to FIG. 10, in a water heating apparatus 100*c* including the combustion apparatus according to the third embodiment, a check valve 130 is arranged in a mixture passage 15 from air blowing fan 11 to burner 10. Controller 50 controls burner 10 and air blowing fan 11. Specifically, controller 50 can control an amount of supply of fuel gas by controlling a gas valve 13, and control combustion by burner 10. Controller 50 receives detection values by rotation speed sensor 41 and current sensor 42 of air blowing fan 11 and controls the rotation speed of air blowing fan 11 as described in the first embodiment.

Figure 11:
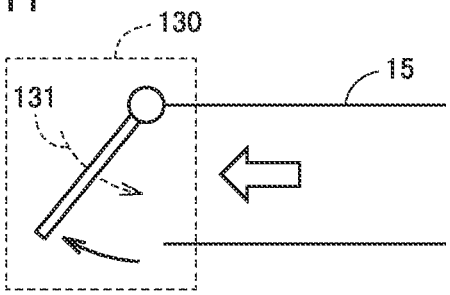
FIG. 11 is a conceptual diagram for illustrating a configuration of a check valve shown in FIG. 10.

FIG. 11 is a conceptual diagram for illustrating a configuration of check valve 130.

Referring to FIG. 11, check valve 130 is implemented by a flapper valve and closes the gas passage using biasing force 131 produced by a spring or the like, when a gas pressure is not generated in mixture passage 15. This state corresponds to "closed state" of check valve 30 in FIG. 2(*a*).

When the gas pressure generated as a result of operation of air blowing fan 11 exceeds biasing force 131, check valve 130 is opened and enters "intermediate state" in FIG. 2(*b*) and "open state" in FIG. 2(*c*). That is, similarly to check valve 30, opening and closing of check valve 130 are controlled based on a relationship between the gas pressure and the biasing force. Therefore, also in mixture passage 15 having check valve 130 arranged therein, the different P-Q characteristics are exhibited in the closed state, in the intermediate state, and in the open state, similarly to FIG. 4.

Therefore, for the combustion apparatus according to the third embodiment as well, characteristic lines 101 to 103 (FIG. 4) indicating the P-Q characteristics and characteristic lines 151 to 153 (FIG. 5) in accordance with the P-Q characteristics can be obtained by a preliminary test conducted on an actual device, or the like.

Thus, in the combustion apparatus according to the third embodiment, the failure diagnosis of check valve 130 can be performed using fan rotation speed Nf and fan current If detected by rotation speed sensor 41 and current sensor 42, similarly to the first embodiment.

Alternatively, pressure sensor 21 similar to that in FIG. 8 may be arranged in mixture passage 15, and thus, in the combustion apparatus according to the third embodiment, the failure diagnosis of check valve 130 can be performed using fan rotation speed Nf and gas pressure Px detected by rotation speed sensor 41 and pressure sensor 21, similarly to the second embodiment.

Thus, the failure diagnosis of the check valve not driven by an actuator as described in the first and second embodiments is applicable to a check valve arranged at an arbitrary location in a supply and exhaust passage in a combustion apparatus including the configurations described in PTLs 1 and 2.

In addition, a configuration of a user interface similar to that in FIG. 7 can be applied to water heating apparatuses 100*b* and 100*c* described in the second and third embodiments and at least one of startup of the failure diagnosis of check valve 30 and notification of the diagnosis result can be performed using communication terminal 400 (400*a*, 400*b*). Similarly, the common vent configuration shown in FIG. 3 can be applied to water heating apparatuses 100*b* and 100*c* described in the second and third embodiments. Although the failure diagnosis process that can detect both "open failure" and "closed failure" has been illustrated in the first to third embodiments (FIGS. 6 and 9), the failure diagnosis process can also be modified into a failure diagnosis process that detects only one of "open failure" and "closed failure".

It should be understood that the embodiments disclosed herein are illustrative and non-restrictive in every respect. The scope of the present invention is defined by the terms of the claims, rather than description above, and is intended to include any modifications within the scope and meaning equivalent to the terms of the claims.

REFERENCE SIGNS LIST

10 burner; 11 air blowing fan; 12 heat exchanger; 13 gas valve; 15 mixture passage; 20 exhaust passage; 21 pressure sensor, 25 exhaust vent; 27 shared gas tube (exhaust side); 28 shared gas tube (supply side); 30, 130 check valve; 31, 131 biasing force; 41 rotation speed sensor; 42 current sensor; 50 controller, 100*a*, 100*b*, 100*c* water heating apparatus; 101 to 103 characteristic line (P-Q); 151 to 153 characteristic line (Nf-If); 200, 300 remote controller; 202, 302 power switch; 203, 204, 303 operation switch; 205, 305 display; 210, 310 communication line; 330 LAN router; 350 Internet; 380 server; 400, 400*a*, 400*b* communication terminal; If fan current; Ifr reference current value (fan current); Nf fan rotation speed; P exhaust pressure (gas pressure); Q exhaust flow rate (gas flow rate).

The invention claimed is:

1. A combustion apparatus comprising:

a combustion mechanism that burns a fuel;

an air blowing fan that supplies air for combustion to the combustion mechanism;

an exhaust vent through which combustion gas in the combustion mechanism is discharged;

a check valve arranged in a supply and exhaust passage from the air blowing fan to the exhaust vent, the check valve being opened and closed in accordance with a relationship between a gas pressure in the supply and exhaust passage and a biasing force in a closing direction;

a controller that performs a failure diagnosis for detecting an open failure of the check valve when a phenomenon in which the gas pressure is lower than a predetermined normal pressure range is detected in a diagnosis rotation speed region, the diagnosis rotation speed region being set within a rotation speed range of the air blowing fan in which a degree of opening of the check valve changes with an increase in a rotation speed of the air blowing fan when the check valve is normally opened and closed;

a rotation speed sensor that detects the rotation speed of the air blowing fan; and a current sensor that detects a driving current of the air blowing fan, wherein the controller prestores a characteristic relationship of a reference current value in association with the rotation speed in the diagnosis rotation speed region, and detects the open failure by detecting the phenomenon in which the gas pressure is lower than the normal pressure range, when a detection value of the driving current at the time of the failure diagnosis is higher than a normal current range including the reference current value, the normal current range being obtained by referring to the characteristic relationship based on a detection value of the rotation speed at the time of the failure diagnosis.

2. The combustion apparatus according to claim 1, wherein the controller detects a closed failure of the check valve by detecting a phenomenon in which the gas pressure is higher than the normal pressure range, when the detection value of the driving current at the time of the failure diagnosis is lower than the normal current range at the time of the failure diagnosis.

3. A combustion apparatus comprising:

a combustion mechanism that burns a fuel;

an air blowing fan that supplies air for combustion to the combustion mechanism;

an exhaust vent through which combustion gas in the combustion mechanism is discharged;

a check valve arranged in a supply and exhaust passage from the air blowing fan to the exhaust vent, the check valve being opened and closed in accordance with a relationship between a gas pressure in the supply and exhaust passage and a biasing force in a closing direction; and a controller that performs a failure diagnosis for detecting an open failure of the check valve when a phenomenon in which the gas pressure is lower than a predetermined normal pressure range is detected in a diagnosis rotation speed region, the diagnosis rotation speed region being set within a rotation speed range of the air blowing fan in which a degree of opening of the check valve changes with an increase in a rotation speed of the air blowing fan when the check valve is normally opened and closed, wherein the failure diagnosis is automatically started up when a combustion operation by the combustion mechanism is not in execution.

4. The combustion apparatus according to claim 3, wherein the failure diagnosis can be started up in response to a prescribed operation input to an operation terminal of the combustion apparatus, and the combustion apparatus further comprises a notification unit that provides information for seeking confirmation as to whether or not placement of the check valve is forgotten, when the open failure is detected in the failure diagnosis started up by the operation input.

5. The combustion apparatus according to claim 4, wherein at least one of the operation terminal and the notification unit includes a communication terminal communicatively connected to the combustion apparatus.

6. A combustion apparatus comprising:

a combustion mechanism that burns a fuel;

an air blowing fan that supplies air for combustion to the combustion mechanism;

an exhaust vent through which combustion gas in the combustion mechanism is discharged;

a check valve arranged in a supply and exhaust passage from the air blowing fan to the exhaust vent, the check valve being opened and closed in accordance with a relationship between a gas pressure in the supply and exhaust passage and a biasing force in a closing direction; and a controller that performs a failure diagnosis for detecting an open failure of the check valve when a phenomenon in which the gas pressure is lower than a predetermined normal pressure range is detected in a diagnosis rotation speed region, the diagnosis rotation speed region being set within a rotation speed range of the air blowing fan in which a degree of opening of the check valve changes with an increase in a rotation speed of the air blowing fan when the check valve is normally opened and closed, wherein the controller detects a closed failure of the check valve, when a phenomenon in which the gas pressure is higher than the normal pressure range in the diagnosis rotation speed region, at the time of the failure diagnosis.

* * * * *